US011591676B2

(12) United States Patent
Han et al.

(10) Patent No.: US 11,591,676 B2
(45) Date of Patent: Feb. 28, 2023

(54) STEEL SHEET WITH EXCELLENT BAKE HARDENING PROPERTIES AND CORROSION RESISTANCE AND METHOD FOR MANUFACTURING SAME

(71) Applicant: POSCO, Pohang-si (KR)

(72) Inventors: Sang-Ho Han, Gwangyang-si (KR); Je-Woong Lee, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 16/956,247

(22) PCT Filed: Nov. 30, 2018

(86) PCT No.: PCT/KR2018/015023
§ 371 (c)(1),
(2) Date: Jun. 19, 2020

(87) PCT Pub. No.: WO2019/124807
PCT Pub. Date: Jun. 27, 2019

(65) Prior Publication Data

US 2020/0340086 A1 Oct. 29, 2020

(30) Foreign Application Priority Data

Dec. 24, 2017 (KR) ..... 10-2017-0178939

(51) Int. Cl.

| | |
|---|---|
| ***C22C 38/04*** | (2006.01) |
| ***C22C 38/18*** | (2006.01) |
| ***C23C 2/06*** | (2006.01) |
| ***C23C 2/28*** | (2006.01) |
| ***C23C 2/40*** | (2006.01) |
| *C21D 8/02* | (2006.01) |
| *C21D 9/46* | (2006.01) |

(52) U.S. Cl.
CPC ..... *C22C 38/04* (2013.01); *C22C 38/18* (2013.01); *C23C 2/06* (2013.01); *C23C 2/28* (2013.01); *C23C 2/40* (2013.01); *C21D 8/0226* (2013.01); *C21D 8/0236* (2013.01); *C21D 9/46* (2013.01)

(58) Field of Classification Search
CPC .... C21D 6/002; C21D 8/0205; C21D 8/0226; C21D 8/0236; C21D 9/46; C22C 38/00; C22C 38/18; C22C 2/06; C22C 2/28; C22C 2/40
USPC ..... 148/333
See application file for complete search history.

(56) References Cited

U.S. PATENT DOCUMENTS

| | | | | |
|---|---|---|---|---|
| 6,306,527 | B1 * | 10/2001 | Ikeda | C21D 1/185 148/533 |
| 6,410,163 | B1 * | 6/2002 | Suzuki | C23C 2/02 428/659 |
| 2003/0099857 | A1 | 5/2003 | Nomura et al. | |
| 2003/0129444 | A1 | 7/2003 | Matsuoka et al. | |
| 2010/0132850 | A1 | 6/2010 | Ono et al. | |
| 2012/0225761 | A1 * | 9/2012 | Gaspard | C22C 38/22 492/3 |
| 2013/0340898 | A1 * | 12/2013 | Takashima | C22C 38/02 148/603 |
| 2016/0186282 | A1 | 6/2016 | Han et al. | |
| 2016/0340755 | A1 | 11/2016 | Han | |
| 2018/0002771 | A1 | 1/2018 | Han et al. | |
| 2018/0202020 | A1 | 7/2018 | Han et al. | |
| 2020/0063233 | A1 | 2/2020 | Han et al. | |

FOREIGN PATENT DOCUMENTS

| | | | |
|---|---|---|---|
| EP | 1960562 B1 * | 8/2015 | C21D 8/0205 |
| JP | H04041658 | 2/1992 | |
| JP | 04346625 | 12/1992 | |
| JP | 2003129172 | 5/2003 | |
| JP | 2003129174 | 5/2003 | |
| JP | 2004292891 | 10/2004 | |
| JP | 2005264176 | 9/2005 | |
| JP | 2009518541 | 5/2009 | |
| JP | 2013064172 | 4/2013 | |
| JP | 2013139624 | 7/2013 | |
| JP | 2013185240 | 9/2013 | |
| JP | 2013227635 | 11/2013 | |
| KR | 20020073564 | 9/2002 | |
| KR | 100711358 | 4/2007 | |
| KR | 100711468 | 4/2007 | |
| KR | 20100060565 | 6/2010 | |
| KR | 20110119285 | 11/2011 | |
| KR | 101560900 | 10/2015 | |
| KR | 101561007 | 10/2015 | |
| KR | 101561008 | 10/2015 | |
| KR | 20160078571 | 7/2016 | |
| KR | 20170012865 | 2/2017 | |

(Continued)

OTHER PUBLICATIONS

NPL: on-line translation of JP 2003129174 A, May 2003 (Year: 2003).*
International Search Report—PCT/KR2018/015023 dated Feb. 25, 2019.
European Search Report—European Application No. 18890153.2 dated Oct. 20, 2020, citing WO 2007/067014, JP 2013-064172, KR 2010-0060565, JP 2013-185240, JP 2013-139624, KR 2011-0119285, US 2010/0132850, and US 2016/0340755.

(Continued)

*Primary Examiner* — Jie Yang

(74) *Attorney, Agent, or Firm* — Cantor Colburn LLP

(57) ABSTRACT

Provided is a steel sheet used as a material for an automotive exterior panel, etc., and a method for manufacturing the same. More particularly, provided is a cold-rolled steel sheet and a hot-dip galvanized steel sheet, which have excellent bake hardening properties, corrosion resistance, and anti-aging properties, and a method for manufacturing the same.

7 Claims, No Drawings

(56) References Cited

FOREIGN PATENT DOCUMENTS

| | | |
|---|---|---|
| KR | 101797401 | 11/2017 |
| WO | 2007067014 | 6/2007 |

OTHER PUBLICATIONS

Japanese Office Action—Japanese Application No. 2020-534833 dated Sep. 28, 2021, citing JP 2013-129174, JP H04-041658, JP 2009-518541, JP 2018-528323, JP 2003-129172, JP 2013-227635, US 2003/0099857, and KR 10-2010-0060565.

* cited by examiner

STEEL SHEET WITH EXCELLENT BAKE HARDENING PROPERTIES AND CORROSION RESISTANCE AND METHOD FOR MANUFACTURING SAME

TECHNICAL FIELD

The present disclosure relates to a steel sheet used as a material for an automotive external panel, and the like, and a method for manufacturing the same. More particularly, the present disclosure relates to a cold-rolled steel sheet and a hot-dip galvanized steel sheet, each having excellent bake hardening properties, corrosion resistance, and anti-aging properties, and a method for manufacturing the same.

BACKGROUND ART

As impact stability regulations and the fuel efficiency of automobiles have been emphasized, high tensile steel has been actively used to satisfy requirements for reducing weight and achieving high strength in automobile bodies. In accordance with this trend, high-strength steel has been increasingly applied to external panels of automobiles.

Currently, 340 MPa-grade bake hardened steel has mostly been used in external panels of automobiles, but 490 MPa-grade steel sheets are also being partially applied, and it is expected that 590 MPa-grade steel sheets will also be increasingly applied.

When such steel sheets having increased strength are applied as an external panel as described above, weight reductions and dent resistance may improve, whereas, as strength increases, formability may be deteriorated, which is a disadvantage. Accordingly, recently, customers are demanding a steel sheet having a relatively low yield ratio (YR=YS/TS) and relatively high ductility to supplement poor workability while applying high-strength steel to an external panel.

In addition, to be applied as a material for external panels of automobiles, a steel sheet may be required to have a certain level or higher bake hardenability. A phenomenon of bake hardenability is a phenomenon in which yield strength increases due to adhesion of solid solution carbon and nitrogen, activated during a paint baking process, onto dislocations formed during a pressing process. It may be easy to form steel having excellent bake hardenability before a paint baking process, and final products thereof may have enhanced dent resistance. Thus, such steel may be very ideal as a material for the external panels of automobiles. In addition, to apply the steel as the material for external automobile panels, the steel may be required to have a certain level of aging resistance to guarantee aging for a certain period of time or longer.

As conventional techniques for improving workability in a high-strength steel sheet, Patents Documents 1 to 3, and the like, have been known. Patent Document 1 discloses a steel sheet having a complex-phase structure in which martensite is mainly included, and discloses a method of manufacturing a high-strength steel sheet in which a fine Cu precipitate having a grain size of 1 to 100 nm is dispersed in a structure to improve workability. However, in this technique, it is necessary to add an excessive content, 2 to 5% of Cu, to precipitate fine Cu particles. In this case, red shortness caused by Cu may occur, and manufacturing costs may be excessively increased.

Patent Document 2 discloses a steel sheet having a complex-phase structure including ferrite as a main phase, retained austenite as a secondary phase, and bainite and martensite as low temperature transformation phases, and a method for improving ductility and stretch flangeability of the steel sheet. However, this technique has problems in that it may be difficult to secure plating quality and to secure surface quality in a steel making process and a continuous casting process, since large amounts of Si and Al are added to secure the residual austenite phase. Also, a yield ratio may be high as an initial YS value is high due to transformation induced plasticity, which is another disadvantage.

Patent Document 3 discloses a steel sheet including both of soft ferrite and hard martensite as a microstructure, and a manufacturing method for improving an elongation and an r value (a Lankford value) of the steel sheet as a technique for providing a high tensile hot-dip galvanized steel sheet having good workability. However, this technique has problems, in that it may be difficult to secure good plating quality, since a large amount of Si is added and manufacturing costs may be increased due to the addition of large amounts of Ti and Mo.

(Patent Document 1) Japanese Laid-Open Patent Publication No. 2005-264176

(Patent Document 2) Japanese Laid-Open Patent Publication No. 2004-292891

(Patent Document 3) Korean Laid-Open Patent Publication No. 2002-0073564

DISCLOSURE

Technical Problem

An aspect of the present disclosure is to provide a steel sheet having excellent bake hardening properties, corrosion resistance, and anti-aging properties, and a method for manufacturing the same.

Technical Solution

According to an aspect of the present disclosure, a steel sheet having excellent bake hardening properties and corrosion resistance including, by weight percentage (wt %), carbon (C): 0.005 to 0.08%, manganese (Mn): 1.25% or less (excluding 0%), phosphorus (P): 0.03% or less (excluding 0%), sulfur (S): 0.01% or less (excluding 0%), nitrogen (N): 0.01% or less (excluding 0%), soluble aluminum (sol.Al): 0.01 to 0.06%, chromium (Cr): 1.0 to 2.5%, antimony (Sb): 0.1% or less (excluding 0%), at least one selected from the group consisting of nickel (Ni): 0.3% or less (excluding 0%), silicon (Si): 0.3% or less (excluding 0%), molybdenum (Mo): 0.2% or less (excluding 0%), and boron (B): 0.003% or less (excluding 0%), a remainder of iron (Fe), and other unavoidable impurities, satisfying Relational Expression 1 below, and including, by an area percentage (area %), 1 to 5% of martensite and a remainder of ferrite, $$1.3 \le Mn(wt\ \%)+Cr(wt\ \%)/1.5+Sb(wt\ \%) \le 2. \quad \text{Relational Expression 1:}$$

where Mn, Cr, and Sb refer to contents (wt %) of corresponding elements, respectively.

The steel sheet may further include a hot-dip galvanized layer formed on a surface of the steel sheet.

According to another aspect of the present disclosure, a method for manufacturing a steel sheet having excellent bake hardening properties and corrosion resistance includes reheating a slab comprising, by weight percentage (wt %), carbon (C): 0.005 to 0.08%, manganese (Mn): 1.25% or less (excluding 0%), phosphorus (P): 0.03% or less (excluding 0%), sulfur (S): 0.01% or less (excluding 0%), nitrogen (N): 0.01% or less (excluding 0%), soluble aluminum (sol.Al):

0.01 to 0.06%, chromium (Cr): 1.0 to 2.5%, antimony (Sb): 0.1% or less (excluding 0%), at least one selected from the group consisting of nickel (Ni): 0.3% or less (excluding 0%), silicon (Si): 0.3% or less (excluding 0%), molybdenum (Mo): 0.2% or less (excluding 0%), and boron (B): 0.003% or less (excluding 0%), a remainder of iron (Fe), and other unavoidable impurities, and satisfying Relational Expression 1 below, hot rolling the reheated slab at a temperature within a range of 850° C. to 1150° C. to obtain a hot-rolled steel sheet, cooling the hot-rolled steel sheet to a temperature within a range of 550° C. to 750° C. at a cooling rate of 10° C./sec to 70° C./sec, coiling the cooled hot-rolled steel sheet within a temperature range of 550° C. to 750° C., cold rolling the hot-rolled steel sheet to obtain a cold-rolled steel sheet, continuously annealing the cold-rolled steel sheet to a temperature within a range of $Ac_1$+20° C. to $Ac_3$−20° C. under a hydrogen concentration of 3 vol % to 30 vol %, and primarily cooling the continuously annealed cold-rolled steel sheet to a temperature of 630° C. to 670° C. at an average cooling rate of 2° C./sec to 10° C./sec, $$1.3 \leq Mn(wt\ \%)+Cr(wt\ \%)/1.5+Sb(wt\ \%) \leq 2.7 \quad \text{Relational Expression 1:}$$

where Mn, Cr, Sb refer to contents (wt %) of corresponding elements, respectively.

The method may further include secondarily cooling the primarily cooled cold-rolled steel sheet at an average cooling rate of 4° C./sec to 20° C./sec until the primarily cooled cold-rolled steel sheet is dipped into a hot-dip zinc-based plating bath maintained at a temperature of 440° C. to 480° C., dipping the secondarily cooled cold-rolled steel sheet into the hot-dip zinc-based plating bath, maintained at a temperature of 440° C. to 480° C., to obtain a hot-dip galvanized steel sheet, and finally cooling the hot-dip galvanized steel sheet to (Ms-100)° C. or less at a cooling rate of 3° C./sec or more.

Advantageous Effects

According to the present disclosure, a cold-rolled steel sheet and a hot-dip galvanized steel sheet may be preferably applied to materials for external panels of automobiles, or the like, due to excellent bake hardening properties, corrosion resistance, and anti-aging properties thereof.

BEST MODE FOR INVENTION

The present disclosure is based on results obtained by conducting intensive research and experiments to provide a cold-rolled steel sheet and a hot-dip galvanized steel sheet, each having excellent bake hardening properties, corrosion resistance, and anti-aging properties as well as excellent formability by securing both strength and ductility to be appropriate as materials for external panels of automobiles.

The present disclosure provides a steel sheet having better corrosion resistance while appropriately controlling a composition range and a microstructure of the steel sheet to secure material physical properties equivalent to or better than those of conventional steel sheets.

The present disclosure provides a steel sheet having better plating adhesion and corrosion resistance by inducing segregation of antimony (Sb) in an interface between martensite and ferrite grain boundaries to suppress surface dissolution of manganese (Mn), chromium (Cr), or the like, during annealing.

The present invention provides a steel sheet in which a relative ratio of Mn and Cr, elements for improving hardenability, is optimized to secure better corrosion resistance and Sb is appropriately added to have excellent bake hardening properties and plating adhesion as well as excellent corrosion resistance.

The present disclosure provides a steel sheet having excellent corrosion resistance, strength, ductility, and formability as well as excellent plating adhesion, bake hardening properties, and anti-aging properties by appropriately controlling a composition range and manufacturing conditions of the steel sheet.

Hereinafter, a steel sheet having excellent bake hardening properties and corrosion resistance according to an aspect of the present disclosure will be described.

A steel sheet having excellent bake hardening properties and corrosion resistance according to an aspect of the present disclosure includes, by weight percentage (wt %), carbon (C): 0.005 to 0.08%, manganese (Mn): 1.25% or less (excluding 0%), phosphorus (P): 0.03% or less (excluding 0%), sulfur (S): 0.01% or less (excluding 0%), nitrogen (N): 0.01% or less (excluding 0%), soluble aluminum (sol.Al): 0.01 to 0.06%, chromium (Cr): 1.0 to 2.5%, antimony (Sb): 0.1% or less (excluding 0%), at least one selected from the group consisting of nickel (Ni): 0.3% or less (excluding 0%), silicon (Si): 0.3% or less (excluding 0%), molybdenum (Mo): 0.2% or less (excluding 0%), and boron (B): 0.003% or less (excluding 0%), a remainder of iron (Fe), and other unavoidable impurities, satisfies Relational Expression 1, and includes, by an area percentage (area %), 1 to 5% of martensite, and a remainder of ferrite, $$1.3 \leq Mn(wt\ \%)+Cr(wt\ \%)/1.5+Sb(wt\ \%) \leq 2.7 \quad \text{Relational Expression 1:}$$

where Mn, Cr, and Sb refer to contents (weight percentage) of corresponding elements, respectively.

Hereinafter, alloy components and content ranges of a steel sheet will be described in detail. It is to be noted that the content of each component described below is based on weight unless otherwise specified.

C: 0.005 to 0.08%

Carbon (C) is an essential element added to secure a complex-phase structure aimed in the present disclosure. In general, the greater the content of carbon, the easier the formation of martensite, which may be advantageous in manufacturing complex phase steel. However, to secure intended strength and a yield ratio (yield strength/tensile strength), the content of carbon is required to be appropriately controlled. When the content of carbon is lower than 0.005%, it may be difficult to secure the strength aimed in the present disclosure, and it may be difficult to form an appropriate level of martensite. When the content of carbon is greater than 0.08%, the formation of grain boundary bainite may be facilitated during cooling after annealing to cause disadvantages such as an increase in yield ratio of steel and easy occurrence of indentations and surface defects when processing the steel into a vehicle component. Accordingly, in the present disclosure, the content of carbon may be set to 0.005 to 0.08% and, in further detail, 0.007 to 0.06%.

Mn: 1.25% or Less (Excluding 0%)

Manganese (Mn) is an element improving hardenability in complex phase steel, and is particularly important in forming martensite. However, when the content of Mn is increased, a Mn oxide is dissolved in a surface layer of the steel sheet during annealing to deteriorate not only plating adhesion but also weldability during welding after forming components. In particular, since adhesion of base steel and a plating layer is deteriorated to cause poor corrosion resistance, which make it difficult to apply to a steel material for automobiles. The present inventors performed various experiments on hardenability elements, such as Mn, Cr, and B for forming fine martensite, using ultra-low carbon steel, and then confirmed that bake hardening steel, capable of guarantee anti-aging at room temperature, could be produced and corrosion resistance was significantly excellent due to formation of fine martensite when steel was produced using Cr as a hardenability element. The present disclosure has been completed by the above confirmation.

When the content of Mn was greater than 1.25% and fine martensite was formed, required material characteristics were secured but corrosion resistance was deteriorated because the content of Cr was relatively small. Such a result was different from the objective of the present disclosure. For this reason, the content of Mn was set to be less than 1.25% to confirm that the corrosion resistance was improved and a lower limit value thereof was not defined (excluding 0%). Accordingly, the content of Mn is controlled to 1.25% or less and, in further detail, 0.5 to 1.0%.

P: 0.03% or Less (Excluding 0%)

Phosphorus (P) may be most advantageous in securing strength without significant deterioration of formability. However, when P is excessively included, the possibility of brittle fracture may be significantly increased to significantly increase the possibility that strip breakage of a slab will occur during hot rolling and to deteriorate plating surface properties. Therefore, in the present disclosure, the content of phosphorus may be controlled to 0.03% or less.

S: 0.01% or Less (Excluding 0%)

Sulfur (S) is an impurity unavoidably included in steel, and the content of S is preferably controlled to be low as possible. Since S in steel may increase the possibility of hot shortness, in the present disclosure, the content of S is controlled to 0.01% or less.

N: 0.01% or Less (Excluding 0%)

Nitride (N) is an impurity unavoidably included in steel, and it may be important to control the content of N to be low as possible. To this end, steel refinement costs may be significantly increased, and thus, the content of N may be controlled to 0.01% or less, a range in which operational conditions is able to be implemented.

Al (sol.Al): 0.01 to 0.06%

Soluble aluminum (sol.Al) may be added for gain refinement and deoxidation. When the content of sol.Al is less than 0.01%, generally used stable aluminum-killed (Al-killed) steel may not be produced. When the content of sol.Al is greater than 0.06%, the content may be advantageous in increasing strength due to a grain refinement effect, but inclusions may be excessively formed during a continuous casting process in steelmaking to increase the possibility that a surface defect of a plating steel sheet occurs, and manufacturing costs may be significantly increased. Therefore, in the present disclosure, the content of sol.Al is controlled to 0.01 to 0.06%.

Cr: 1.0 to 2.5%

Chromium (Cr) has characteristics, similar to those of Mn, and is added to improve strength of steel along with hardenability of steel. In addition, Cr helps in the formation of martensite and may precipitate an appropriate amount or less of solid solution carbon in steel by forming coarse Cr-based carbide such as $Cr_{23}C_6$ during hot rolling to inhibit occurrence of yield point elongation (YP-El). Therefore, Cr is advantageous in manufacturing complex phase steel having a low yield ratio. In addition, Cr significantly reduces a decrease in ductility, as compared with an increase in strength, to be advantageous in manufacturing high-strength complex phase steel having high ductility. However, when the content of Cr is less than 1.0%, a required martensite structure may not be formed. When the content of Cr is greater than 2.5, strength may be increased and elongation may be decreased due to an excessive martensite fraction. Therefore, in the present disclosure, the content of Cr is controlled to 1.0 to 2.5% and, in further detail, 1.3 to 1.8%.

Sb: 0.1% or Less (Excluding 0%)

Antimony (Sb) is an element playing an important role in the present disclosure. In the present disclosure, the content of C is as low as possible, in detail, 0.005% to 0.04%, and Fine martensite (M) is distributed in the steel using hardenability elements, such as Mn, Cr, or the like, to produce bake hardening steel having excellent anti-aging properties.

However, Mn and Cr may cause plating separation because surface layers of Mn and Cr-based oxides are dissolved during annealing to deteriorate plating adhesion. Accordingly, a small amount of Sb is added to segregate first to grain boundaries of the M (martensite) phase, such that Mn, Cr, or the like, may be prevented from migrating along the grain boundaries to improve quality of a plating surface. Since a sufficient effect may be obtained even when a small amount of Sb is added, a lower limit, excluding 0%, is not specifically set. When the content of Sb is greater than 0.1%, excessive presence of Sb results in an increase in alloy cost and the possibility that surface cracking occurs in hot rolling. Therefore, an upper limit of the content of Sb is limited to 0.1%. In further detail, it is advantageous to limit the content of Sb to 0.005 to 0.04%.

At least one selected from the group consisting of Ni: 0.3% or less (excluding 0%), Si: 0.3% or less (excluding 0%), Mo: 0.2% or less (excluding 0%), B: 0.003% or less (excluding 0%)

Ni: 0.3% or Less (Excluding 0%)

Nickel (Ni) is an alloying element commonly used together with Cr, and is used to strengthen a matrix because Ni refines a structure of steel and is well solid-solubilized in austenite and ferrite. When Ni coexists with Cr or Mo, Ni exhibits excellent hardenability and is useful in improving corrosion resistance. When the content of Ni is greater than 0.3%, the corrosion resistance may be advantageous but manufacturing costs may be increased and weldability may be adversely affected. Therefore, an upper limit is limited to 0.3% or less. In the present disclosure, since an effect of Ni helps in improving corrosion resistance due to an interaction with Cr even when a small amount of Ni is added, a lower limit value is not necessarily limited and the amount of added Ni is, in detail, 0.3% or less (excluding 0%) in economic terms and, in further detail, 0.03 to 0.1%.

Si: 0.3% or Less (Excluding 0%)

Silicon (Si) contributes to an increase in strength of steel sheet due to solid solution strengthening, but is not intentionally added in the disclosure. Even when Si is not added, physical properties may be secured without any major impediment. However, 0% is excluded in consideration of the amount of Si unavoidably added during a manufacturing process. On the other hand, when the content of Si is greater than 0.3%, plating surface properties are deteriorated. Therefore, in the present disclosure, the content of Si is controlled to 0.3% or less.

Mo: 0.2% or Less (Excluding 0%)

Molybdenum (Mo) is an element added to delay the transformation of austenite into pearlite and to refine the ferrite and improve the strength of steel. In addition, Mo helps in improving hardenability of the steel. However, when the content of Mo is greater than 0.2%, economic efficiency is lowered due to a rapid increase in manufacturing costs and ductility of the steel is lowered. In the present invention, the content of Mo is controlled to 0.2% or less. A lower limit of the content of Mo is not necessarily limited because an effect of Mo is high even when a small amount of Mo is added. The amount of Mo is set to, in further detail, 0.005 to 0.1%.

B: 0.003% or Less (Excluding 0%)

Boron (B) is an element added to prevent secondary work brittleness caused by phosphorus in steel, but there is no major impediment in terms of securing physical properties even when B is not added. On the other hand, when the content of boron is greater than 0.003%, ductility of the steel may be deteriorated. Therefore, in the present disclosure, the content of B is controlled to 0.003% or less.

In addition, the steel sheet includes a remainder of iron (Fe) and other unavoidable impurities. However, since unintended impurities may be unavoidably incorporated from raw materials or a surrounding environment during a typical steelmaking process, the unintended impurities may not be excluded. Since the unintended impurities are obvious to those skilled in the art, detailed descriptions thereof are not necessarily provided in the present specification. In addition, addition of an effective component other than the above composition is not excluded.

The above-described Mn, Cr, and Sb satisfy Relational Expression 1.

$$1.3 \leq Mn(wt\ \%)+Cr(wt\ \%)/1.5+Sb(wt\ \%) \leq 2.7 \quad \text{Relational Expression 1:}$$

where Mn, Cr, and Sb refer to contents (weight percentage) of corresponding elements, respectively.

Relational Expression 1 is obtained by experimentally confirming hardenability depending on steel components under various conditions, and an optimized design range was derived by decreasing the content of Mn as much as possible and increasing the content of Cr. When a combination of components, capable of improving corrosion resistance while securing the same level of mechanical properties with respect to the content of Mn included in steel based on the same content of C, is that Cr is added 1.5 times as much as Mn, required physical properties may be secured. In particular, Sb may be added to improve plating adhesion and corrosion resistance while significantly dissolution to a surface during annealing of Mn in the steel.

In Relational Expression 1, in the case of less than 1.3, required martensite cannot be formed, and thus, a yield ratio may be increased and anti-aging properties at room temperature may be deteriorated. In the case of greater than 2.7, manufacturing costs and yield strength are increased due to excess addition of components to result in high possibility that working cracking occurs during component working. Therefore, the range thereof is limited to, in detail, 1.3 to 2.7 and, in further detail, 1.8 to 2.5.

A cold-rolled steel sheet having excellent bake hardening properties and corrosion resistance according to an aspect of the present disclosure includes, by area %, 1 to 5% of martensite and a remainder of ferrite as a microstructure.

When an area ratio of martensite is less than 1%, it may be difficult to obtain a steel sheet having a low yield ratio due to difficulty in the formation of a composite structure. In particular, when the content of martensite (M) is less than 1%, C included in steel insufficiently aggregates in a martensite phase and remains in a ferrite phase. Therefore, it may be difficult to secure anti-aging properties at room temperature and to lower bake hardening properties. On the other hand, when the content of martensite is greater than 5%, it may be difficult to secure desired workability due to an excessive increase in strength. According to an example, when the content of martensite in the steel sheet is less than 1%, solid-solubilized carbon included in steel may be present in ferrite phase rather than martensite. Therefore, it may be difficult to secure anti-aging properties at room temperature. Since the solid-solubilized carbon present in the ferrite phase is easily transported to be fixed to dislocation, anti-aging properties were deteriorated to obtain an experimental result that anti-aging properties at room temperature were lowered. In addition, when the content of martensite is greater than 5%, an alloy should be further added and yield strength is significantly increased to cause cracking during working, so that an upper limit of the content of martensite is limited to 5%.

Therefore, an area ratio of martensite is, in detail, 1 to 5 area % and, in further detail, 1.5 to 3 area %.

The steel sheet may have yield strength of 210 to 270 MPa and a yield ratio (YS/TS) of 0.6 or less.

A steel sheet having excellent bake hardening properties and corrosion resistance according to another aspect of the present disclosure includes the above-described steel sheet and a hot-dip galvanized layer formed on a surface of the above-described steel sheet.

In the present disclosure, a composition of the hot-dip galvanized layer is not necessarily limited, and may be a pure galvanized layer or a zinc-based alloy plating layer including Si, Al, Mg, or the like. The hot-dip galvanized layer may be an alloying hot-dip galvanized layer.

A plating steel sheet, including the hot-dip galvanized layer, may be a hot-dip zinc-based plating steel sheet and may have yield strength of 210 to 270 MPa and a yield ratio (YS/TS) of 0.6 or less.

The above-described steel sheet according to the present disclosure may be manufactured by various methods, and a method for manufacturing the same is not necessarily limited. However, the above-described steel sheet according to the present disclosure may be manufactured by a method to be described below as an example.

Hereinafter, a method for manufacturing a steel sheet having excellent bake hardening properties and corrosion resistance, another aspect of the present disclosure, will be described below in detail.

A method for manufacturing a steel sheet having excellent bake hardening properties and corrosion resistance according to another aspect of the present disclosure includes reheating a slab including, by weight percentage (wt %), carbon (C): 0.005 to 0.08%, manganese (Mn): 1.25% or less (excluding 0%), phosphorus (P): 0.03% or less (excluding 0%), sulfur (S): 0.01% or less (excluding 0%), nitrogen (N): 0.01% or less (excluding 0%), soluble aluminum (sol.Al): 0.01 to 0.06%, chromium (Cr): 1.0 to 2.5%, antimony (Sb): 0.1% or less (excluding 0%), at least one selected from the group consisting of nickel (Ni): 0.3% or less (excluding 0%), silicon (Si): 0.3% or less (excluding 0%), molybdenum (Mo): 0.2% or less (excluding 0%), and boron (B): 0.003% or less (excluding 0%), a remainder of iron (Fe), and other unavoidable impurities, and satisfying Relational Expression 1 below, hot rolling the reheated slab at a temperature within a range of 850° C. to 1150° C. to obtain a hot-rolled steel sheet, cooling the hot-rolled steel sheet to a temperature within a range of 550° C. to 750° C. at an average cooling rate of 10° C./sec to 70° C./sec, coiling the cooled hot-rolled steel sheet within a temperature range of 550° C. to 750° C., cold rolling the hot-rolled steel sheet to obtain a cold-rolled steel sheet, continuously annealing the cold-rolled steel sheet to a temperature within a range of $Ac_1$+20° C. to $Ac_3$−20° C. under a hydrogen concentration of 3 vol % to 30 vol %, and primarily cooling the continuously annealed cold-rolled steel sheet to a temperature of 630° C. to 670° C. at an average cooling rate of 2° C./sec to 10° C./sec, $$1.3 \leq Mn(wt\ \%)+Cr(wt\ \%)/1.5+Sb(wt\ \%) \leq 2.7 \quad \text{Relational Expression 1:}$$

where Mn, Cr, Sb refer to contents (wt %) of corresponding elements, respectively.

Reheating Slab

A slab having the above-mentioned component system is reheated. A slab reheating temperature is set to be, in detail, 1180° C. to 1350° C.

This process is performed to smoothly perform a subsequent hot rolling process and to sufficiently obtain physical properties of a target steel sheet. In this case, when the reheating temperature is less than 1180° C., oxides such as Mn, Cr, and the like, are insufficiently re-dissolved to cause a deviation of mechanical property and a surface defect after the hot rolling. Therefore, the reheating temperature is, in detail, 1180° C. or higher. When the reheating temperature is higher than 1350° C., strength is lowered by abnormal grain growth of austenite grains. Therefore, the reheating temperature is limited to, in detail, 1180° C. to 1350° C.

Obtaining Hot-Rolled Steel Sheet

The reheated slab is hot-rolled at a temperature within a range of 850° C. to 1150° C. to obtain a hot-rolled steel sheet. In this case, a finish hot rolling temperature is higher than an $Ar_3$ temperature.

When the hot rolling is initiated at a temperature higher than 1150° C., a temperature of the hot-rolled steel sheet is increased to coarsen grains and to deteriorate surface quality of the hot-rolled steel sheet. In addition, when the hot rolling is finished at a temperature lower than 850° C., development of elongated grains and high yield ratio are obtained due to excessive recrystallization retardation to deteriorate cold rollability and shear workability.

Cooling and Coiling Hot-Rolled Steel Sheet

The hot-rolled steel sheet is cooled to a temperature within a range of 550° C. to 750° C. at an average cooling rate of 10° C./sec to 70° C./sec and is coiled to a temperature within a range of 550° C. to 750° C.

In this case, when the hot-rolled steel sheet is cooled and coiled to a temperature lower than 550° C., a bainite phase and a martensite phase are formed in the steel to deteriorate a material of the steel. When the hot-rolled steel sheet is cooled and coiled to a temperature higher than 750° C., coarse ferrite grains are formed and coarse carbide and nitride are likely to be formed. Thus, a material of the steel is deteriorated.

In addition, when an average cooling rate is less than 10° C./sec during cooling, coarse ferrite grains are formed to cause a microstructure to be non-uniform. When the average cooling rate is greater than 70° C./sec, a bainite phase is likely to be formed and the microstructure also becomes non-uniform in a thickness direction of the steel sheet to deteriorate shear workability of the steel.

Obtaining Cold-Rolled Steel Sheet

The cooled and coiled hot-rolled steel sheet is cold-rolled to obtain a cold-rolled steel sheet.

During the cold rolling, a cold rolling reduction ratio may be 40 to 80%. When the cold rolling reduction ratio is less than 40%, it may be difficult to secure a target thickness, and it may be difficult to correct a shape of the steel sheet. On the other hand, when the cold rolling reduction ratio is greater than 80%, cracking may occur in an edge portion of the steel sheet and a cold rolling load may be caused.

For example, the cold rolling may be performed using a rolling mill having five or six stands. In this case, an initial stand reduction ratio may be set to 25% to 37%.

When the initial stand reduction rate is less than 25%, there may be a limitation in controlling the shape of the hot-rolled steel sheet. When the cold-rolled steel sheet is annealed and then cooled, uniform martensite may not be formed in a structure due to non-uniformity of a martensite nucleation site. When the initial stand reduction rate is greater than 37%, an equipment burden may be caused by an increase in the initial stand reduction ratio. Therefore, the initial stand reduction ratio may be limited to 25% to 37% during cold rolling. The initial stand reduction ratio is set to, in detail, 30% to 35%.

Continuously Annealing Cold-Rolled Steel Sheet

The cold-rolled steel sheet is continuously annealed to a temperature within a range of $Ac_1$+20° C. to $Ac_3$-20° C. under a hydrogen concentration of 3 vol % to 30 vol %.

This process is performed to form ferrite and austenite concurrently with recrystallization and to distribute carbon.

In the present disclosure, fine martensite in the steel is managed in the range of 1 area % to 5 area % to ensure anti-aging properties at room temperature, and a steel sheet is manufactured by limiting a concentration of hydrogen in atmosphere in a furnace to a range of 3% to 30% under an annealing temperature of $Ac_1$+20° C. to $Ac_3$−20° C. to manufacture a steel sheet having a bake hardening property of 35 MPa or more at a temperature of baking (conventionally, 170° C. for 20 minutes). When the annealing temperature is lower than $Ac_1$+20° C., an austenite fraction is insufficient at a low two-phase (ferrite+austenite) temperature. Accordingly, since fine martensite is insufficiently formed during cooling after final annealing, bake hardening properties required in the present disclosure may not be obtained. When the annealing temperature is higher than $Ac_3$−20° C., the austenitic fraction during annealing in two-phase region is so high that martensite is coarse, and the martensite fraction is greater than 5% after annealing and cooling. Accordingly, the strength is rapidly increased to result in high possibility that the working cracking occurs during component forming. Therefore, the annealing temperature is limited to, in detail, $Ac_1$+20° C. to $Ac_3$−20° C.

$Ac_1$ and to $Ac_3$ may be obtained, for example, as in Relational Expression 2 below, $$Ac_1(°\ C.)=723-10.7[Mn]-16.9[Ni]+29.1[Si]+16.9[Cr]$$

$$Ac_3(°\ C.)=910-203\sqrt{C}-15.2Ni+44.7Si+104V+31.5Mo+13.1W \quad \text{Relational Expression 2:}$$

where [C], [Mn], [Cu], [Cr], [Ni], [W], and [Mo] refer to weight percentage of corresponding elements, respectively.

On the other hand, when a concentration of hydrogen is less than 3 vol %, surface enrichment of elements, having high affinity to oxygen such as Si, Mn, and B contained in steel is likely to be formed to cause a dent and a plating defect. Meanwhile, when the concentration of hydrogen is greater than 30 vol %, a defect inhibiting effect of the elements reaches a limit and it is disadvantageous in terms of manufacturing costs. Therefore, the concentration of hydrogen is set to, in detail, 3 vol % to 30 vol %.

Primary Cooling of Continuously Annealed Cold-Rolled Steel Sheet

The continuously annealed cold-rolled steel sheet is primarily cooled to a temperature within a range of 630° C. to 670° C. at an average cooling rate of 2° C./sec to 10° C./sec.

In the present disclosure, as a primary cooling termination temperature is controlled to be higher or a primary cooling rate is controlled to be low, a tendency of uniformity and coarseness of ferrite is increased, which is advantageous in securing ductility of steel.

In addition, a main feature of the present disclosure is to give a sufficient time required to diffuse carbon to austenite during the primary cooling, which is significantly meaningful in the present disclosure. More specifically, in a two-phase region, carbon diffuses and migrates to austenite in which the degree of enrichment of carbon is high. The higher the temperature and the longer the time, the more the degree of diffusion is increased. When the primary cooling termination temperature is lower than 630° C., pearlite or bainite may be formed due to a significantly low temperature to increase a yield ratio and to increase a tendency of occurrence of cracking during working. On the other hand, when the primary cooling termination temperature is higher 670° C., a large amount of ferrite may be formed during cooling and the content austenite for forming martensite is low, and thus, 1% to 5%, the final content of the martensite, may not be effectively controlled.

In addition, when the primary cooling rate is less than 2° C./sec, it is disadvantageous in terms of productivity and a ferrite fraction is increased to cause the low content of austenite for forming martensite. Meanwhile, when the primary cooling rate is greater than 10° C./sec, bainite may be formed such that yield strength is increased to deteriorate properties of a material. In the present disclosure, it is preferable to significantly inhibit the formation of bainite or pearlite, other than fine martensite.

Hereinafter, a method for manufacturing a hot-dip galvanized steel sheet having excellent bake hardening properties and corrosion resistance according to another aspect of the present disclosure will be described in detail.

The method for manufacturing a hot-dip galvanized steel sheet having excellent bake hardening properties and corrosion resistance according to another aspect of the present disclosure may include, in addition to the above-described method for manufacturing a cold-rolled steel sheet, secondarily cooling the primarily cooled cold-rolled steel sheet until it is dipped into a hot-dip zinc-based plating bath maintained at a temperature of 440° C. to 480° C. at an average cooling rate of 4° C./sec to 20° C./sec, dipping the secondarily cooled cold-rolled steel sheet into the hot-dip zinc-based plating bath, maintained at a temperature of 440° C. to 480° C., to obtain a hot-dip galvanized steel sheet, and finally cooling the hot-dip galvanized steel sheet to (Ms-100) ° C. or less at a cooling rate of 3° C./sec or more.

Secondarily Cooling Cold-Rolled Steel Sheet

As described above, the primarily cooled cold-rolled steel sheet is secondarily cooled until it is dipped into a hot-dip zinc-based plating bath maintained at a temperature of 440° C. to 480° C. at an average cooling rate of 4° C./sec to 20° C./sec.

According to the researches of the present inventors, when martensite is formed before passing through 440° C. to 480° C., a temperature range of a conventional hot-dip zinc-based bath, coarse martensite is formed on the finally obtained cold-rolled steel sheet, such that a low yield ratio cannot be achieved.

When the secondary cooling rate is greater than 20° C./sec, a portion of martensite may be formed during the secondary cooling, and distortion of a steel sheet may occur due to an increase in passage speed in terms of productivity. On the other hand, when the secondary cooling rate is less than 4° C./sec, fine bainite may be formed due to a significantly low cooling rate to cause a deviation of mechanical property in a width direction. Accordingly, since the shape of the steel sheet is worsened, the secondary cooling rate is controlled to, in detail, 4° C./sec to 20° C./sec.

Obtaining Hot-Dip Galvanized Steel Sheet

As described above, the secondarily cooled cold-rolled steel sheet is dipped into a hot-dip zinc-based plating bath, maintained at a temperature of 440° C. to 480° C., to obtain a hot-dip galvanized steel sheet.

In the present disclosure, a composition of the hot-dip zinc-based plating bath is not necessarily limited, and may be a pure zinc plating bath or a zinc-based alloy plating bath including Si, Al, Mg, and the like.

Finally Cooling Hot-Dip Galvanized Steel Sheet

The hot-dip galvanized steel sheet is finally cooled to (Ms-100)° C. or less at a cooling rate of 3° C./sec or more.

The (Ms-100) ° C. is a cooling condition for forming martensite.

A theoretical temperature of the Ms may be calculated by, for example, Relational Expression 3 below, $$Ms(^\circ C.)=539-423[C]-30.4[Mn]-12.1[Cr]-17.7[Ni]-7.5[Mo] \quad \text{Relational Expression 3:}$$

where [C], [Mn], [Cr], [Ni], and [Mo] refer to weight percentage (wt %) of corresponding elements, respectively.

When a final cooling termination temperature is more than (Ms-100)° C., fine martensite may not be obtained, and a shape defect of the steel sheet may occur.

On the other hand, when the average cooling rate is less than 3° C./sec, martensite is irregularly formed in grains or grain boundaries due to the significantly low cooling rate, a formation ratio of martensite in grain boundaries is low compared to martensite in grains, and thus, steel having a low yield ratio may not be produced. An upper limit value of the average cooling rate is not greatly limited because equipment characteristics are not as problematic as possible.

Obtaining Alloyed Hot-Dip Galvanized Steel Sheet

As necessary, before the final cooling, the method may further include performing an alloying heat treatment on the hot-dip galvanized steel sheet to obtain an alloyed hot-dip galvanized steel sheet.

In the present disclosure, conditions of the alloying heat treatment are not necessarily limited and may be conventional conditions. As an example, the alloying heat treatment may be performed within a temperature range of 500° C. to 540° C.

Temper Rolling

As necessary, the method may further include temper rolling the finally cooled hot-dip galvanized steel sheet or alloyed hot-dip galvanized steel sheet.

When temper rolling is performed, a large amount of dislocation may be are formed in the ferrite disposed around martensite to further improve the baking hardening properties.

In this case, a reduction ratio is, in detail, 0.3% to 1.6% and, in further detail, 0.5% to 1.4%. When the reduction ratio is less than 0.3%, a sufficient dislocation is not formed and it is disadvantageous in terms of a shape of the steel sheet, and in particular, a plating surface defect may occur. On the other hand, when the reduction ratio is greater than 1.6%, it is advantageous in terms of formation of dislocation, but a side effect such as strip breakage, or the like, may occur due to a limitation in equipment capacity.

Hereinafter, embodiments of the present disclosure will be described more specifically through examples. However, the examples are for clearly explaining the embodiments of the present disclosure and are not intended to limit the scope of the present invention.

MODE FOR INVENTION

Example

After preparing a steel slab having an alloying composition shown in Table 1, a hot-dip galvanized steel sheet (a GI steel sheet) or an alloyed hot-dip galvanized steel sheet (a GA steel sheet) was manufactured using the manufacturing process shown in Tables 2 and 3. In this case, hot-dip galvanization was performed using a conventional hot-dip zinc-based plating bath and an alloying heat treatment was also performed under a conventional condition (500° C. to 540° C.)

For the reference, Inventive Steels 1, 2, 4 and 5 and Comparative Steels 1 and 2 in Table 1 correspond to alloyed hot-dip galvanized steel sheets, and Inventive Steels 3, 6 and 7 in Table 1 correspond to hot-dip galvanized steel sheets. Comparative steel 1 is a BH steel using usually ultra-low carbon steel, and Comparative Steel 2 is steel of a series of high-carbon DP steels.

For each of the above-mentioned plating steel sheets, a microstructure was observed, physical properties were evaluated, and results thereof are shown in Table 4 below.

In Table 4, martensite and bainite were observed at a point of ¼t (t: steel sheet thickness (mm)) through Lepelar corrosion using an optical microscope and were re-observed using a SEM (magnification: 3,000×). Sizes and distribution amounts of the martensite and the bainite were measured using values averaged three times through a Count Point operation, and a phase, except for these structures, was estimated as the content of ferrite. In Table 4, a tensile test was performed on each specimen in a direction C using the JIS standard. In Table 4, YS denotes yield strength and YR denotes a yield ratio.

On the other hand, a low-bake hardening property (L-BH) was measured under a baking condition (170° C.×20 min) and was evaluated as a difference in yield strength after 2% pre-strain. An anti-aging property (YP-El (%)) was measured during the tensile test after being maintained for an hour at a temperature of 100° C. When no YP-El appeared, it was evaluated to have excellent anti-aging properties at room temperature.

An unplated evaluation was made by observation with naked eyes, and a relative evaluation was made to have grades 1 to 5 based on the degree of occurrence of an unplated one. The grades 1 and 2 mean that the quality of external panel materials is secured.

A corrosion resistance evaluation was made by cutting a steel plate in a size of 75×150 mm and then masking edges with a tape for a salt pray corrosion resistance evaluation. Then, prepared specimens entered a salt spray tester having a spray pressure of 0.098±0.0025 MPa and a spraying amount of 1.0 to 2.0 ml per hour. At a point in time since 1,000 hours have passed, the degrees of generation of red rust were compared with each other. The standards for the evaluation were given as below.

◎: less than 5% of a red rust generation area, ○: 5 to 20% of the red rust generation area, Δ: 21 to 50% of the red rust generation area, and x: more than 50% of the red rust generation area

TABLE 1

| Type of Steel | Composition of Cold-Rolled Steel Sheet (wt %) | | | | | | | | | | | |
|---|---|---|---|---|---|---|---|---|---|---|---|---|
| | C | Mn | Si | Cr | P | S | N | Sol. Al | Ni | Sb | Mo | B |
| IS1 | 0.006 | 0.33 | 0.003 | 2.31 | 0.003 | 0.006 | 0.003 | 0.021 | 0.005 | 0.005 | — | 0.0004 |
| IS2 | 0.007 | 0.55 | 0.004 | 2.18 | 0.003 | 0.005 | 0.003 | 0.034 | 0.01 | 0.009 | — | 0.0006 |
| IS3 | 0.010 | 0.72 | 0.003 | 1.75 | 0.003 | 0.004 | 0.002 | 0.045 | — | 0.018 | 0.07 | — |
| IS4 | 0.012 | 0.75 | 0.021 | 1.82 | 0.002 | 0.004 | 0.003 | 0.043 | — | 0.053 | — | 0.0021 |
| IS5 | 0.024 | 0.82 | 0.022 | 1.56 | 0.001 | 0.006 | 0.004 | 0.052 | — | 0.061 | 0.18 | 0.0028 |
| IS6 | 0.031 | 0.93 | 0.008 | 1.69 | 0.003 | 0.004 | 0.005 | 0.026 | — | 0.01 | 0.08 | 0.0008 |
| IS7 | 0.070 | 1.15 | 0.007 | 1.15 | 0.005 | 0.006 | 0.003 | 0.041 | — | 0.04 | 0.03 | 0.0009 |
| CS1 | 0.0018 | 0.15 | 0.003 | — | 0.006 | 0.004 | 0.002 | 0.035 | — | — | — | — |
| CS2 | 0.09 | 1.85 | 1.2 | — | 0.005 | 0.007 | 0.004 | 0.045 | — | — | 0.21 | 0.0018 |

IS: Inventive Steel/CS: Comparative Steel

TABLE 2

| Type of Steel | Hot Rolling | | | | Cold Rolling | |
|---|---|---|---|---|---|---|
| | Reheating Temperature (° C.) | Finish Hot Rolling Temperature (° C.) | Coiling Temperature (° C.) | Cooling Rate before Coiling (° C./sec) | Cold Reduction Ratio (%) | Initial Cold Rolling Stand Reduction Ratio (%) |
| IS1 | 1185 | 886 | 569 | 25 | 54 | 29 |
| | 1186 | 892 | 552 | 33 | 53 | 26 |
| IS2 | 1187 | 904 | 655 | 27 | 65 | 28 |
| | 1187 | 908 | 646 | 31 | 63 | 26 |
| IS3 | 1214 | 895 | 717 | 43 | 73 | 30 |
| | 1212 | 896 | 715 | 55 | 76 | 33 |
| IS4 | 1195 | 887 | 534 | 81 | 38 | 31 |
| | 1196 | 928 | 584 | 19 | 75 | 34 |
| IS5 | 1224 | 846 | 634 | 18 | 57 | 21 |
| | 1228 | 914 | 637 | 8 | 42 | 39 |
| IS6 | 1187 | 894 | 676 | 37 | 83 | 35 |
| | 1194 | 895 | 653 | 36 | 74 | 34 |
| IS7 | 1206 | 899 | 674 | 45 | 34 | 36 |
| | 1207 | 888 | 652 | 56 | 63 | 33 |
| CS1 | 1189 | 915 | 672 | 38 | 74 | 45 |
| CS2 | 1201 | 891 | 535 | 34 | 63 | 37 |
| | 1207 | 898 | 674 | 28 | 63 | 35 |

IS: Inventive Steel/CS: Comparative Steel

TABLE 3

| | Annealing | | Cooling | | | | | | |
|---|---|---|---|---|---|---|---|---|---|
| | | | Primary | | Secondary | | Final | | |
| Type of Steel | Annealing Temperature (° C.) | Concentration of Hydrogen in Furnace (%) | Primary Cooling Rate (° C./sec) | Cooling Termination Temperature (° C.) | Secondary Cooling Rate (° C./sec) | Cooling Termination Temperature (° C.) | Final Cooling Rate (° C./sec) | Cooling Termination Temperature (° C.) | Note |
| IS1 | 782 | 5.1 | 2.6 | 640 | 4.6 | 460 | 4.3 | Room Temp. | IE1 |
| | 782 | 4.5 | 2.5 | 640 | 4.6 | 460 | 5.1 | Room Temp. | IE2 |
| IS2 | 776 | 5.2 | 3.5 | 640 | 4.1 | 460 | 6.2 | Room Temp. | IE3 |
| | 790 | 6.1 | 3.8 | 640 | 4.1 | 460 | 6.9 | Room Temp. | IE4 |
| IS3 | 813 | 5.8 | 4.3 | 640 | 5.2 | 460 | 9.8 | Room Temp. | IE5 |
| | 812 | 5.2 | 9.3 | 640 | 6.1 | 460 | 9.3 | Room Temp. | IE6 |
| IS4 | 675 | 6.1 | 5.6 | 640 | 9.1 | 460 | 5.3 | Room Temp. | CE1 |
| | 831 | 3.5 | 5.8 | 640 | 8.4 | 460 | 7.8 | Room Temp. | IE7 |
| IS5 | 680 | 3.5 | 11.2 | 640 | 11.4 | 460 | 2.5 | Room Temp. | CE2 |
| | 833 | 3.1 | 8.5 | 640 | 12.1 | 460 | 6.4 | Room Temp. | CE3 |
| IS6 | 841 | 2.5 | 7.7 | 640 | 8.9 | 460 | 5.3 | Room Temp. | CE4 |
| | 834 | 38.1 | 15.5 | 640 | 7.2 | 460 | 8.1 | Room Temp. | CE5 |
| IS7 | 845 | 3.5 | 6.7 | 640 | 2.8 | 460 | 2.7 | Room Temp. | CE6 |
| | 835 | 3.2 | 15.5 | 640 | 21 | 460 | 8.4 | Room Temp. | CE7 |
| CS1 | 843 | 3.6 | 4.8 | 640 | 6.5 | 460 | 5.2 | Room Temp. | CE8 |
| CS2 | 815 | 4.4 | 4.9 | 640 | 6.5 | 460 | 5.3 | Room Temp. | CE9 |
| | 781 | 4.5 | 4.1 | 640 | 7.8 | 460 | 3.8 | Room Temp. | CE10 |

IS: Inventive Steel/CS: Comparative Steel
IE: Inventive Example/CE: Comparative Example

TABLE 4

| Type of Steel | ① | ② | ③ | YP-El (%) | L-BH (MPa) | YS (MPa) | YR (MPa) | ④ Unplated | ⑤ Corrosion Resistance | |
|---|---|---|---|---|---|---|---|---|---|---|
| IS1 | 2.5 | 0 | 1.88 | 0 | 38 | 221 | 0.54 | 1 | ◎ | IE1 |
| | 2.2 | 0 | 1.88 | 0 | 42 | 213 | 0.52 | 1 | ◎ | IE2 |
| IS2 | 3.1 | 0 | 2.01 | 0 | 42 | 224 | 0.53 | 1 | ◎ | IE3 |
| | 3.2 | 0 | 2.01 | 0 | 38 | 222 | 0.57 | 1 | ◎ | IE4 |
| IS3 | 3.2 | 0 | 1.90 | 0 | 45 | 232 | 0.54 | 1 | ◎ | IE5 |
| | 4.3 | 0 | 1.90 | 0 | 47 | 234 | 0.52 | 1 | ◎ | IE6 |
| IS4 | 3.2 | 0 | 2.02 | 0.38 | 53 | 224 | 0.52 | 3 | ○ | CE1 |
| | 2.1 | 0 | 2.02 | 0 | 51 | 223 | 0.57 | 1 | ◎ | IE7 |
| IS5 | 6.7 | 0.4 | 1.92 | 0.35 | 48 | 256 | 0.66 | 3 | ○ | CE2 |
| | 4.5 | 0.2 | 1.92 | 0.32 | 46 | 255 | 0.66 | 3 | ○ | CE3 |
| IS6 | 4.6 | 0.6 | 2.07 | 0.31 | 42 | 261 | 0.68 | 3 | ○ | CE4 |
| | 6.2 | 0 | 2.07 | 0.41 | 47 | 263 | 0.62 | 4 | ○ | CE5 |
| IS7 | 1.8 | 0.3 | 1.96 | 0.28 | 47 | 287 | 0.58 | 4 | ○ | CE6 |
| | 2.1 | 1.3 | 1.96 | 0.18 | 33 | 283 | 0.56 | 5 | Δ | CE7 |
| CS1 | 0 | 0 | 0.15 | 0 | 0 | 181 | 0.73 | 2 | ◎ | CE8 |
| CS2 | 8.3 | 3.2 | 1.85 | 0 | 45 | 287 | 0.65 | 4 | Δ | CE9 |
| | 9.1 | 2.5 | 1.85 | 0 | 39 | 291 | 0.66 | 4 | Δ | CE10 |

IS: Inventive Steel/CS: Comparative Steel
IE: Inventive Example/CE: Comparative Example (In Table 4, ① refers to a martensite area ratio (%), ② refers to a bainite area ratio (%), ③ refers to a value of Relation Expression 1: Mn(wt %)+Cr(wt %)/1.5+Sb(wt %), ④ refers to an unplated evaluation (grades 1 and 2: excellent, grades 3 and 4: average, and grade 5: poor), and ⑤ refers to a result of salt spray corrosion resistance evaluation).

As can be seen from Tables 1 to 4, in the case of Inventive Examples 1 to 7 satisfying the alloy composition and manufacturing conditions of the present disclosure, yield strength has a range of 210 to 270 MPa, no yield point elongation (YP-El) appeared during a tensile test after performing a heat treatment on specimens under the condition of 100° C.×60 min, and thus, anti-aging properties and baking hardening property were excellent, a yield ratio (YS/TS) was 0.6 or less, grades thereof were grades 1 and 2, the level of an external panel, during an unplated determination, and corrosion resistance was evaluated to be in the best grade.

Meanwhile, as can be seen from Tables 1 to 4, in Comparative Examples 1 to 10, not satisfying at least one of the alloying composition and the manufacturing conditions of the present disclosure, at least one of the physical properties such as yield strength, yield ratio, baking hardening property, corrosion resistance, and anti-aging property was deteriorated or insufficient.

The invention claimed is:

1. A method of manufacturing a steel sheet, the method comprising:

reheating a slab comprising, by weight percentage (wt %), carbon (C): 0.005 to 0.08%, manganese (Mn): 1.25% or less (excluding 0%), phosphorus (P): 0.03% or less (excluding 0%), sulfur (S): 0.01% or less (excluding 0%), nitrogen (N): 0.01% or less (excluding 0%), soluble aluminum (sol.Al): 0.01 to 0.06%, chromium (Cr): 1.15 to 2.5%, antimony (Sb): 0.1% or less (excluding 0%), at least one selected from the group consisting of nickel (Ni): 0.3% or less (excluding 0%), silicon(Si): 0.3% or less (excluding 0%), molybdenum (Mo): 0.2% or less (excluding 0%), and boron (B): 0.003% or less (excluding 0%), and a remainder of iron (Fe) and other unavoidable impurities, and satisfying Relational Expression 1 below, $$1.3 \leq Mn(wt\ \%)+Cr(wt\ \%)/1.5+Sb(wt\ \%) \leq 2.7 \quad \text{Relational Expression 1:}$$

where Mn, Cr, Sb refer to contents (wt %) of corresponding elements, respectively;

hot rolling the reheated slab at a temperature within a range of 850° C. to 1150° C. to obtain a hot-rolled steel sheet;

cooling the hot-rolled steel sheet to a temperature within a range of 550° C. to 750° C. at an average cooling rate of 10° C./sec to 70° C./sec;

coiling the cooled hot-rolled steel sheet within a temperature range of 550° C. to 750° C. to obtain a coiled hot-rolled steel sheet;

cold rolling the coiled hot-rolled steel sheet to obtain a cold-rolled steel sheet;

continuously annealing the cold-rolled steel sheet to a temperature within a range of $Ac_1$+20° C. to $Ac_3$−20° C. under a hydrogen concentration of 3 vol % to 30 vol %;

primarily cooling the continuously annealed cold-rolled steel sheet to a temperature of 630° C. to 670° C. at an average cooling rate of 2° C./sec to 10° C./sec;

secondarily cooling the primarily cooled cold-rolled steel sheet at an average cooling rate of 4° C./sec to 20° C./sec until the primarily cooled cold-rolled steel sheet is dipped into a hot-dip zinc-based plating bath maintained at a temperature of 440° C. to 480° C.;

dipping the secondarily cooled cold-rolled steel sheet into the hot-dip zinc-based plating bath maintained at a temperature of 440° C. to 480° C. to obtain a hot-dip galvanized steel sheet; and finally cooling the hot-dip galvanized steel sheet to (Ms-100)° C. or less at an average cooling rate of 3° C./sec or more, wherein the cold rolling is performed using a rolling mill having five or six stands, and an initial stand reduction ratio is set to 25% to 37%.

2. The method of claim 1, wherein a reduction ratio during the cold rolling is 40% to 80%.

3. The method of claim 1, before the finally cooling the hot-dip galvanized steel sheet, further comprising:

performing an alloying heat treatment on the hot-dip galvanized steel sheet to obtain an alloyed hot-dip galvanized steel sheet.

4. The method of claim 3, wherein the alloying heat treatment is performed to a temperature within a range of 500° C. to 540° C.

5. The method of claim 3, further comprising: temper-rolling the alloyed hot-dip galvanized steel sheet.

6. The method of claim 1, further comprising:

temper-rolling the hot-dip galvanized steel sheet.

7. The method of claim 6, wherein a reduction ratio during the temper-rolling is 0.3% to 1.6%.

* * * * *